US011376486B2

(12) United States Patent
Garnerone

(10) Patent No.: US 11,376,486 B2
(45) Date of Patent: Jul. 5, 2022

(54) MECHANISM FOR ADJUSTING THE ORIENTATION OF BINDINGS ON A SNOWBOARD

(71) Applicant: BLACK LINE, La Cadiere d'Azur (FR)

(72) Inventor: Rémi Garnerone, La Ciotat (FR)

(73) Assignee: BLACK LINE, La Cadiere d'Azur (FR)

( * ) Notice: Subject to any disclaimer, the term of this patent is extended or adjusted under 35 U.S.C. 154(b) by 0 days.

(21) Appl. No.: 16/970,763

(22) PCT Filed: Feb. 20, 2019

(86) PCT No.: PCT/FR2019/050391
§ 371 (c)(1),
(2) Date: Aug. 18, 2020

(87) PCT Pub. No.: WO2019/162617
PCT Pub. Date: Aug. 29, 2019

(65) Prior Publication Data

US 2020/0368605 A1 Nov. 26, 2020

(30) Foreign Application Priority Data

Feb. 20, 2018 (FR) ..... 1851453

(51) Int. Cl.
*A63C 10/18* (2012.01)

(52) U.S. Cl.
CPC ..... *A63C 10/18* (2013.01); *A63C 2203/12* (2013.01); *A63C 2203/22* (2013.01); *A63C 2203/24* (2013.01)

(58) Field of Classification Search
CPC ..... A63C 10/18
See application file for complete search history.

(56) References Cited

U.S. PATENT DOCUMENTS 5,362,087 A 11/1994 Agid
5,584,492 A * 12/1996 Fardie ..... A63C 10/14 280/14.22

(Continued)

FOREIGN PATENT DOCUMENTS

EP 1941935 A2 7/2008
EP 2036597 A1 3/2009

(Continued)

OTHER PUBLICATIONS

International Search Report (with English translation) and Written Opinion (with Machine translation) dated Jul. 11, 2019 in corresponding International Application No. PCT/FR2019/050391; 15 pages.

*Primary Examiner* — Brian L Swenson
(74) *Attorney, Agent, or Firm* — Maier & Maier, PLLC

(57) ABSTRACT

A device for setting the orientation of a boot binding on a snowboard includes a disk fixable to the board, the binding being mounted to be able to rotate in relation to the disk about a vertical axis of rotation, at least one locking method mounted adjustably between a locked position where it immobilizes the binding in relation to the disk, and an unlocked position where it allows the rotation of the binding around the axis of rotation for an angular adjustment of the binding in relation to the board, the displacement of the locking method is ensured by an actuator, that is remotely controllable, and a locking method and an actuator that are installed in the disk so that: the actuator can be actuated when the boot is retained in the binding and, the locking method is movable by the actuator when the boot is retained in the binding.

14 Claims, 7 Drawing Sheets

(56) References Cited

U.S. PATENT DOCUMENTS

| | | | | |
|---|---|---|---|---|
| 5,820,155 | A * | 10/1998 | Brisco | A63C 10/145 280/607 |
| 8,371,591 | B2 * | 2/2013 | Hwongbo | A63C 10/14 280/14.24 |
| 8,684,394 | B2 * | 4/2014 | Smith | A63C 10/24 280/617 |
| 9,526,971 | B1 * | 12/2016 | Barden | A63C 9/0802 |
| 10,258,862 | B2 * | 4/2019 | Mohler | A63C 5/0417 |
| 2002/0036386 | A1 * | 3/2002 | Murphy | A63C 10/10 280/14.23 |
| 2011/0254239 | A1 * | 10/2011 | Jung | A63C 10/18 280/14.24 |
| 2014/0042728 | A1 * | 2/2014 | Noyes | A63C 10/18 280/612 |
| 2014/0257568 | A1 * | 9/2014 | Czaja | A43B 3/0005 700/275 |
| 2018/0310670 | A1 * | 11/2018 | Rovekamp, Jr. | A63C 10/06 |
| 2019/0358516 | A1 * | 11/2019 | Barden | A63C 9/0802 |

FOREIGN PATENT DOCUMENTS

| | | | |
|---|---|---|---|
| EP | 3006094 | A1 | 4/2016 |
| FR | 2743306 | A1 | 7/1997 |
| FR | 2876041 | A1 | 4/2006 |

* cited by examiner

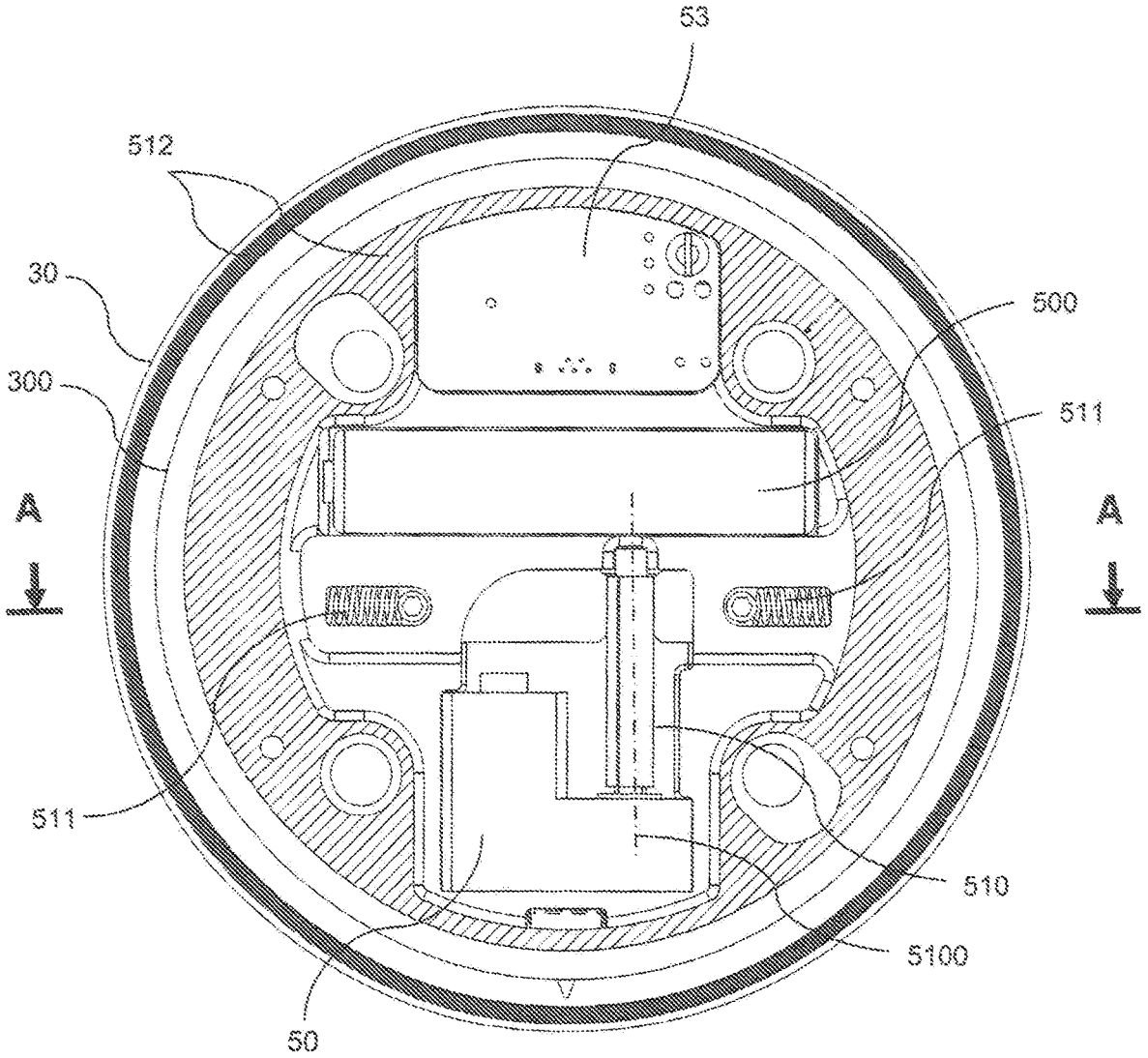
Fig. 11
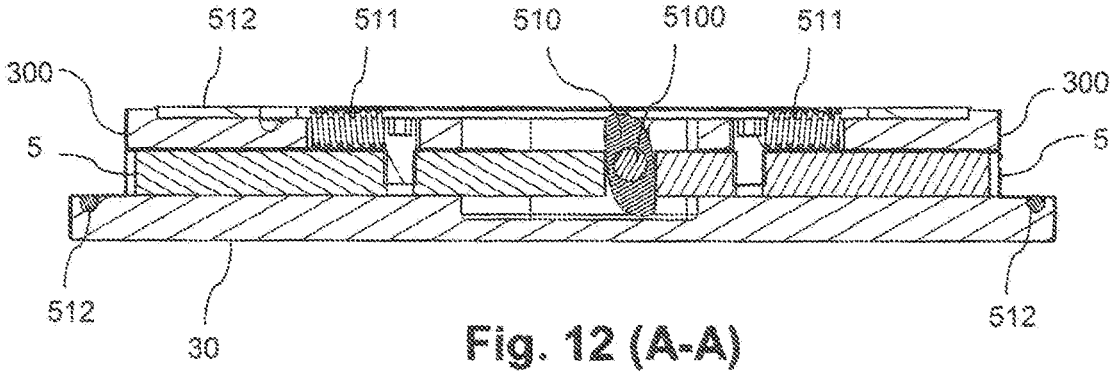
Fig. 12 (A-A)

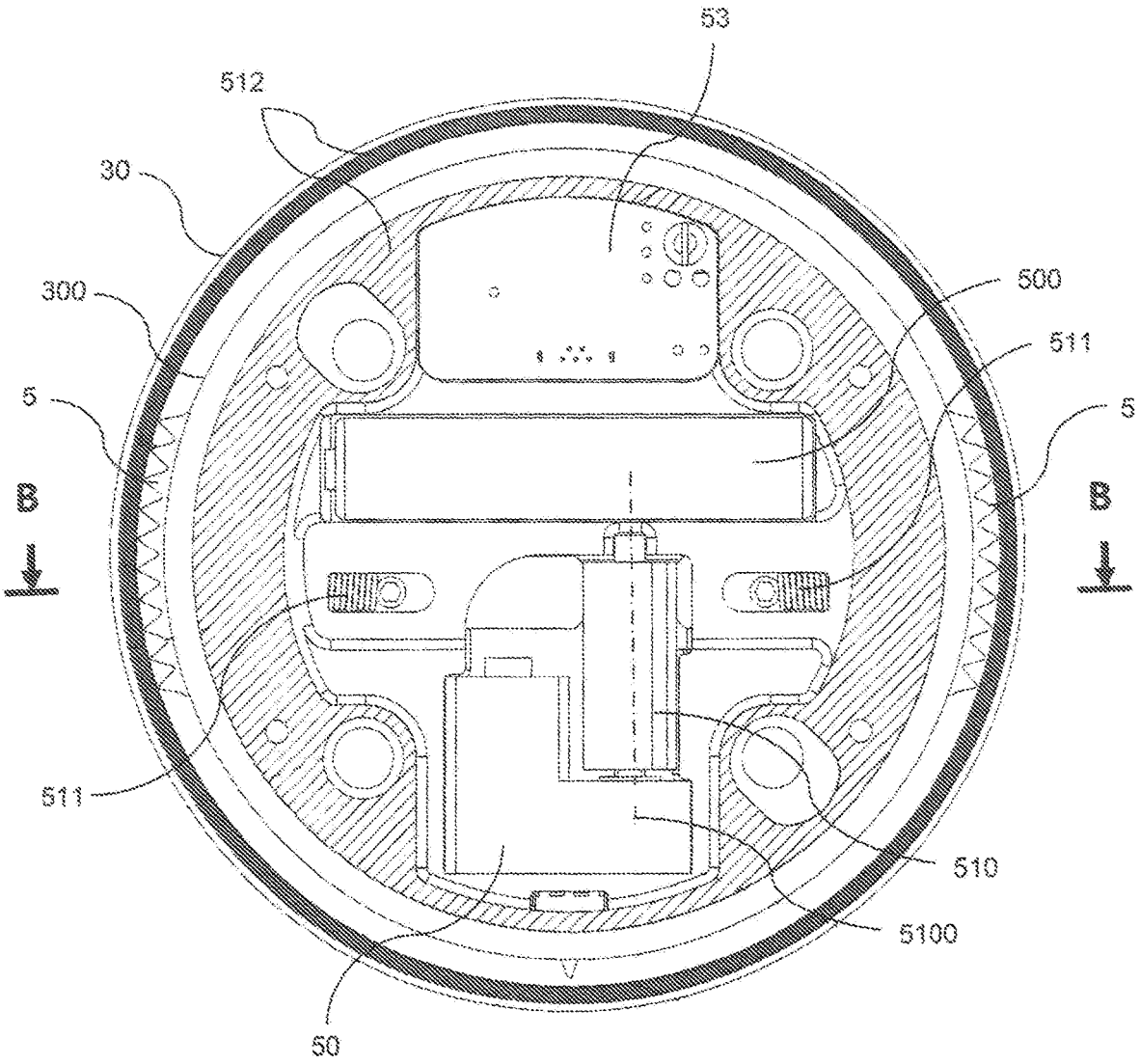
Fig. 13
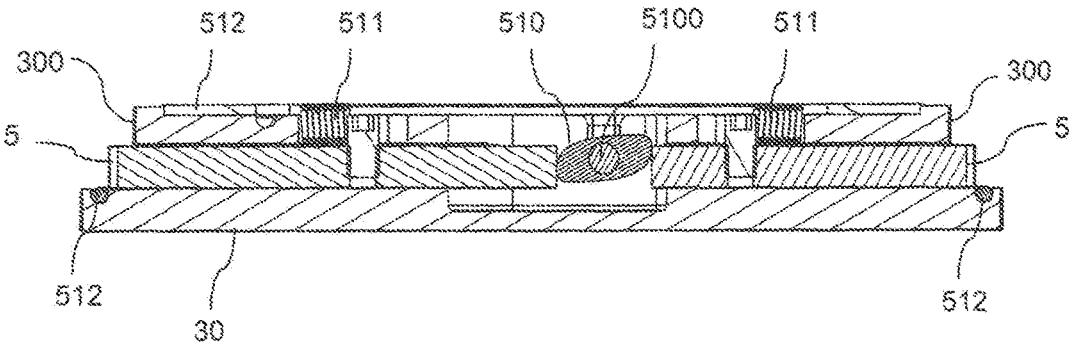
Fig. 14 (B-B)

MECHANISM FOR ADJUSTING THE ORIENTATION OF BINDINGS ON A SNOWBOARD

FIELD

The subject of the invention is a device for setting the orientation of a boot binding on a snowboard.

It applies to the technical field of systems for setting the orientation of the bindings of the boot in relation to the snowboard, the adjustment is made about a vertical axis of rotation.

BACKGROUND

Snowboards are fitted with bindings to hold the user's two boots in an angular position, that is to say at an angle to the general plane of symmetry of the board. Each user has the possibility of setting the angular position of his bindings, and therefore of his boots, permanently or temporarily.

Also, the board is generally mounted with devices for setting the orientation of the boot bindings. Patent documents FR2876041 (Rossignol), U.S. Pat. No. 5,362,087 (Agid Toy) or US 2011/0254239 (Jung) disclose examples of such adjustment devices. In these patent documents, manual locking members ensure the immobilization of the binding at an adjustable immobilization angle. In addition to a relatively complex design of the adjustment device, the locking members can only be manipulated when the boot is out of said binding. The user must therefore systematically remove the boots from the bindings to adjust the orientation of his bindings. In addition, the immobilization angle is generally reduced to about ten degrees.

Snowboarders, especially beginners, generally have great difficulty using a drag lift (surface ski lift). In fact, this type of ski lift is designed for users who ride with their hips facing the slope. However, in snowboarding, the hips are perpendicular to the slope.

Such inconveniences also occur when using chairlifts (aerial ski lifts). If the snowboarder keeps his two feet in his bindings, he must sit sideways, his pelvis being noticeably perpendicular to the seat so that his board is oriented in the axis of the slope so as not to disturb other users seated next to him. If he unstraps his back foot out of the binding, he can sit properly in the seat, but his front foot has to be twisted so that his board is facing the slope. These two postures are particularly uncomfortable.

SUMMARY

The invention aims to remedy this state of affairs. In particular, an objective of the invention is to simplify the adjustment of the orientation of the bindings of a snowboard.

Another objective of the invention is to propose a device for setting the orientation of a snowboard binding which is of simple and inexpensive design.

Yet another objective of the invention is to provide an adjustment device whose usage makes it easier to use the ski lifts.

The solution proposed by the invention is a device for setting the orientation of a boot binding on a snowboard, which comprises:

- a disk intended to be fixed to the board, the binding being mounted in free rotation in relation to said plate, about a vertical axis of rotation,
- at least one locking member mounted, adjustable between:

- a locked position where it immobilizes the binding in relation to the disk, and
  - an unlocked position where it allows the rotation of the binding around the axis of rotation for an angular adjustment of said binding in relation to the snowboard,
- the movement of the locking member between the locked position and the unlocked position is ensured by an actuator,
- the actuator is controlled remotely,
- the locking member and the actuator are installed in the disk so that:
  - said actuator can be actuated when the boot is retained in the binding and,
  - said locking member is movable by said actuator when the boot is retained in said binding.

The user can therefore remotely control the movement of the locking member to adjust the orientation of his binding, without having to take off or unstrap his boot. Said locking member can indeed be manipulated automatically, even when the boot is retained in the binding.

Other advantageous features of the invention are listed below. Each of these characteristics can be considered alone or in combination with the remarkable characteristics defined above, and be the subject, if necessary, of one or more divisional patent applications:

- Advantageously, the device further comprises a ring mounted in adjustable rotation in relation to the disk, around the axis of rotation, said ring is gripped to the binding so that the rotation of said binding causes the rotation of said ring; in the locked position, the locking member ensures the immobilization of the ring in relation to the disk; and in the unlocked position, the locking member allows the rotation of the ring around the axis of rotation and an angular adjustment of the binding in relation to the board.
- Advantageously, the locking member is in the form of retractable teeth installed in the disk which, in the locked position, cooperate with complementary teeth present on the ring.
- Advantageously, the transmitter is in the form of a remote control integrated in a bracelet adapted to be worn by the user.
- Advantageously, the signal emitted by the transmitter is a Bluetooth signal or a radio frequency signal.
- In an alternative embodiment, the transmitter is integrated into a smart phone, the signal emitted by said phone can be a Bluetooth signal or a radio frequency signal.

Another aspect of the invention relates to a snowboard fitted with a pair of boot bindings, a front binding arranged at the front of the board and a rear binding arranged at the rear of said board, the front binding and/or the rear binding is equipped with a setting device conforming to one of the preceding characteristics.

Preferably, the angle of orientation of the front binding is adjustable so that the vertical plane of symmetry of said binding coincides with the vertical plane of general symmetry of said board.

BRIEF DESCRIPTION OF THE FIGURES

Other advantages and characteristics of the invention will appear better upon reading the description of a preferred embodiment which will follow, with reference to the appended drawings, produced by way of indicative and non-limiting examples and in which:

FIG. 11 is a top view of a setting device according to the invention, in an alternative embodiment, the locking member being in the unlocked position;

FIG. 12 is a cross-section view along A-A of the device of FIG. 11;

FIG. 13 shows the setting device of FIG. 11 with the locking member in the locked position; and FIG. 14 is a cross-section view along B-B of the device of FIG. 13.

DETAILED DESCRIPTION OF THE EMBODIMENTS

Figure 9:
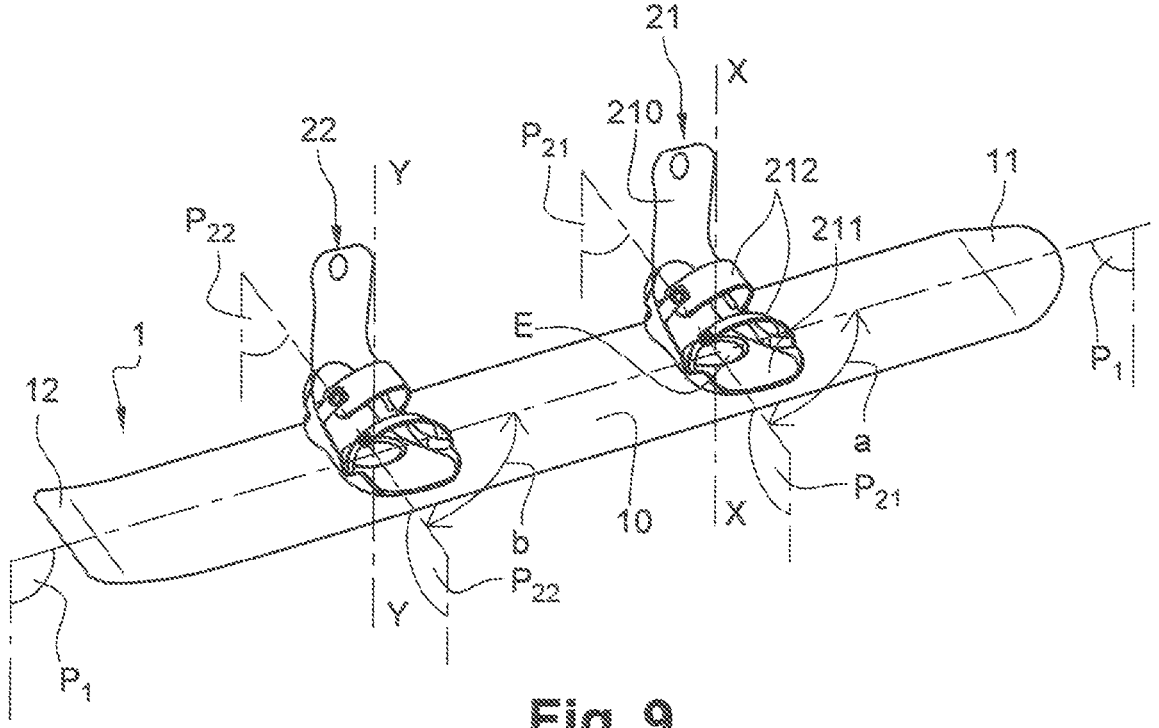
FIG. 9 shows a snowboard provided with a setting device installed in the front binding, the binding is in a first angled position.

Referring to FIG. 9, the snowboard 1 has conventionally: a base 10, a nose 11 and a tail 12. The board 1 has a vertical plane of general symmetry P1.

Figure 1:
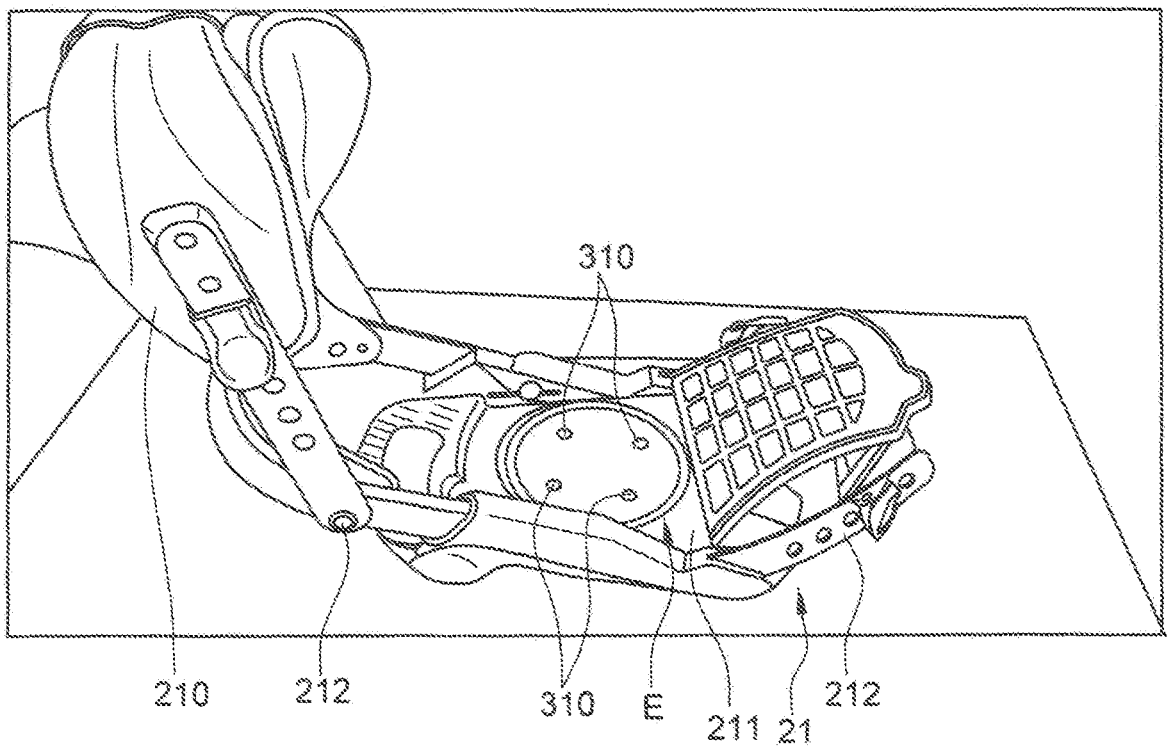
FIG. 1 shows a setting device according to the invention installed in a binding.

A front binding 21 and a rear binding 22 are secured to the board 1, on the upper surface of the base 10. These bindings 21 and 22 are adapted to receive the front boot and the rear boot, respectively, of the user. They are of the classic type, strap, rear entry or hardboot. In FIG. 1, the strap binding 21 is provided with: a rear part 210 ("spoiler" or "highback") on which the boot is pressed against at the calf of the snowboarder; a baseplate 211 on which the boot is placed; one or more straps 212 covering the boot and allowing the foot to be held in the binding.

The bindings 21, 22 are installed so that their respective general plane of symmetry P21, P22 is at an angle relative to the vertical plane of general symmetry P1 of the board 1. The plane of symmetry P21 of the front binding 21 can form with the plane of symmetry P1 of board 1, an angle "a" open towards the nose 11 and between 5° and 15° for example. The plane of symmetry P22 of the rear binding 22 can also form with the plane of symmetry P1 of the board 1, an angle "b" open towards the nose 11 and for example between −15° and 15°. These angles of orientation "a" and "b" depend on the level and the practice of the snowboarder (freestyle, all mountain, freeride, . . . ).

The device making it possible to automatically adjust the orientation of the bindings will now be described with reference to FIGS. 1 to 8.

A disk 30 is fixed to the board 1, on the upper face of the base 10. In the appended figures, this disk 30 in the form of a disc whose diameter is for example between 50 mm and 100 mm and whose thickness is for example between 5 mm and 15 mm. The disk 30 is preferably obtained by molding or plastic injection. A good compromise in terms of cost/resistance is obtained by using a polyamide of type PA.6 reinforced with 30% glass fiber during injection. However, other materials can be used, such as steel or carbon fiber composite materials.

The disk 30 is secured to the base 10 by means of fixing screws 310 which are screwed into threads made in said base 10.

A ring 40 is mounted around the disk 30, being mounted so as to be able to rotate in relation to said disk 30, along a vertical axis of rotation X-X.

Figure 2:
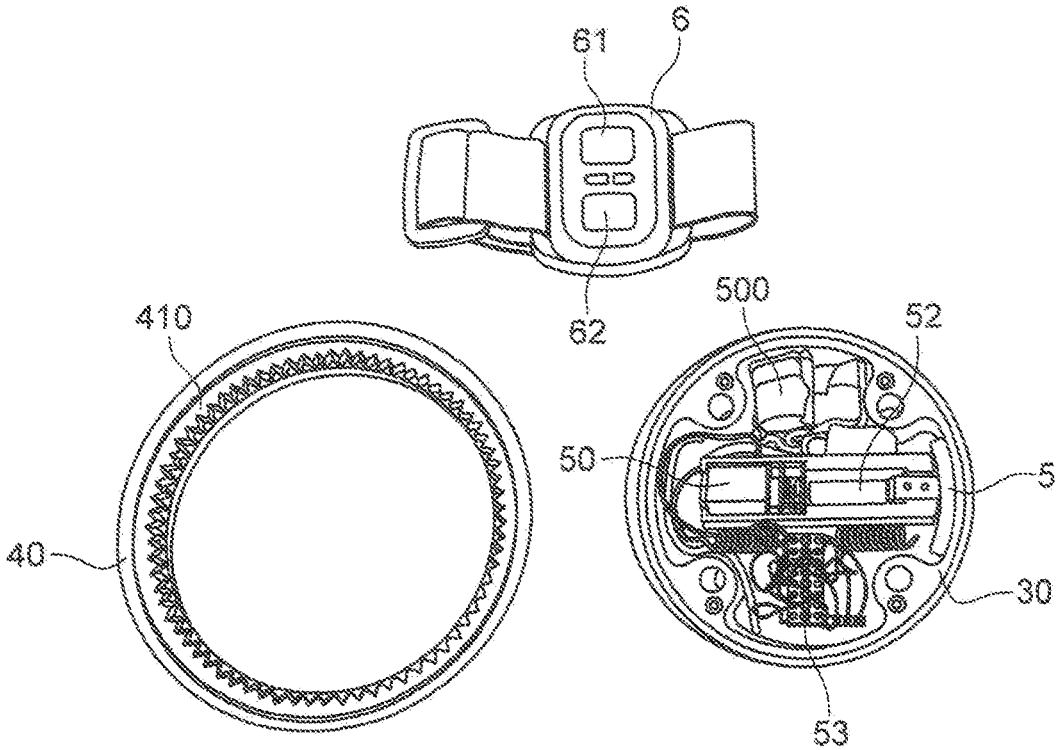
FIG. 2 shows different components of a setting device according to the invention.
Figure 3:
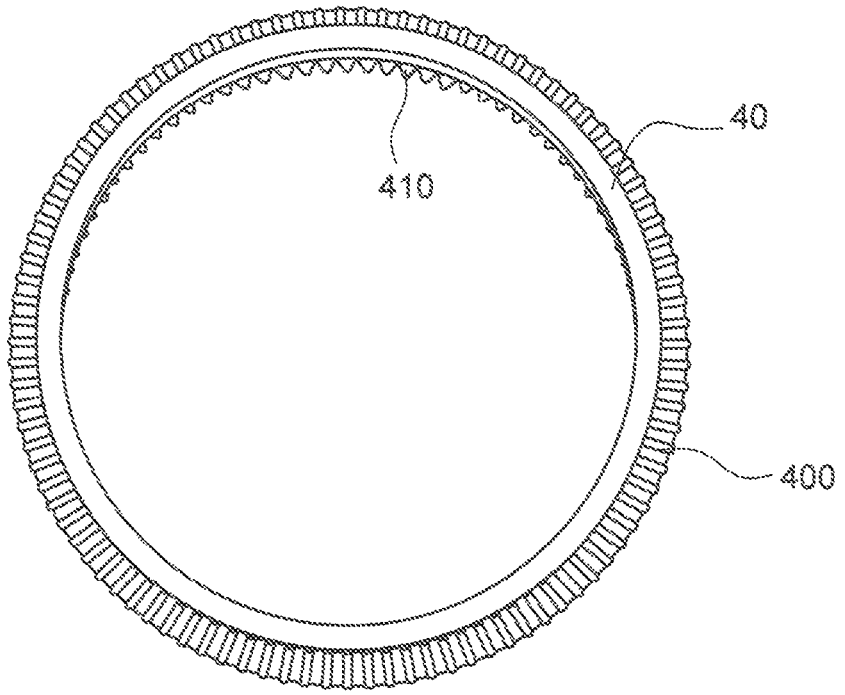
FIG. 3 shows a ring used in a setting device according to the invention.
Figure 4:
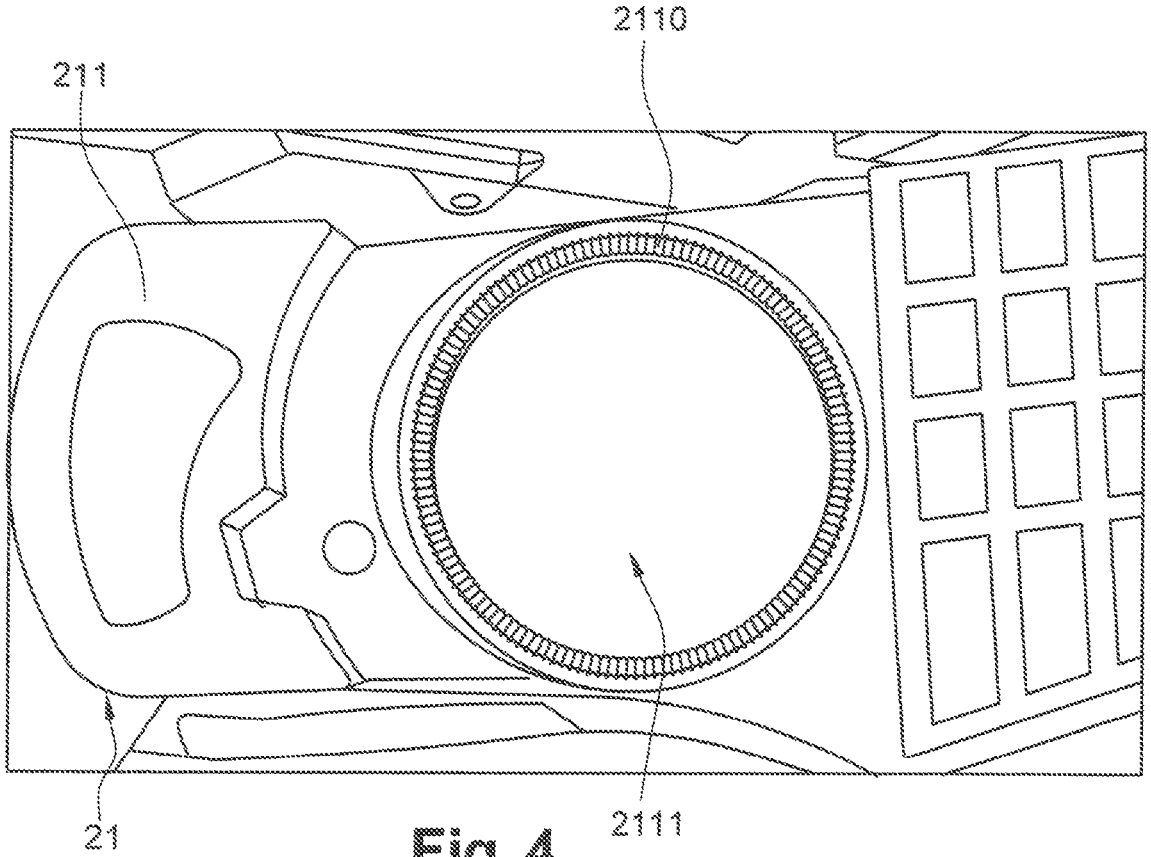
FIG. 4 shows an arrangement made in a binding to receive the ring in FIG. 3.

Referring to FIGS. 2 and 3, the ring 40 has external teeth 400, formed on a lower face of said ring 40. These external teeth 400 are adapted to engage in complementary teeth 2110 produced in an arrangement 2111 of the baseplate 211 (FIG. 4). Thus, when the ring 40 is installed in this arrangement, the teeth 400 and 2110 are engaged so that the rotation of said ring 40 causes the rotation of the fastener 21 for an angular setting of said fastener 21 relative to the board 1. The ring 40 also has internal teeth 410 which extend radially on the internal side wall of said ring 40.

Figure 5:
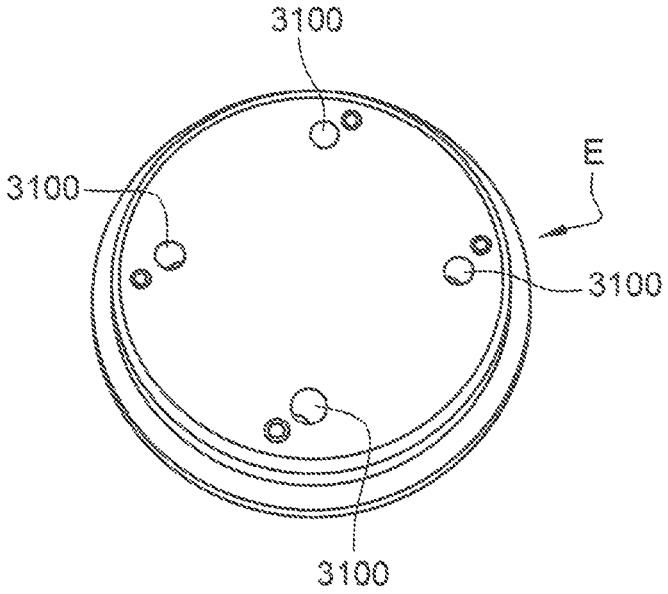
FIG. 5 shows the assembly of a disk and a ring.

Referring to FIGS. 1, 4 and 5, when the ring 40 and the disk 30 are assembled, they form a cylindrical assembly E which fits into the arrangement 2111 of the base plate 211. When the assembly E is mounted in the arrangement 2111, the fixing screws used to secure the disk 30 to the base 10 are inserted through threads 3100 made in said base 10.

Figure 6:
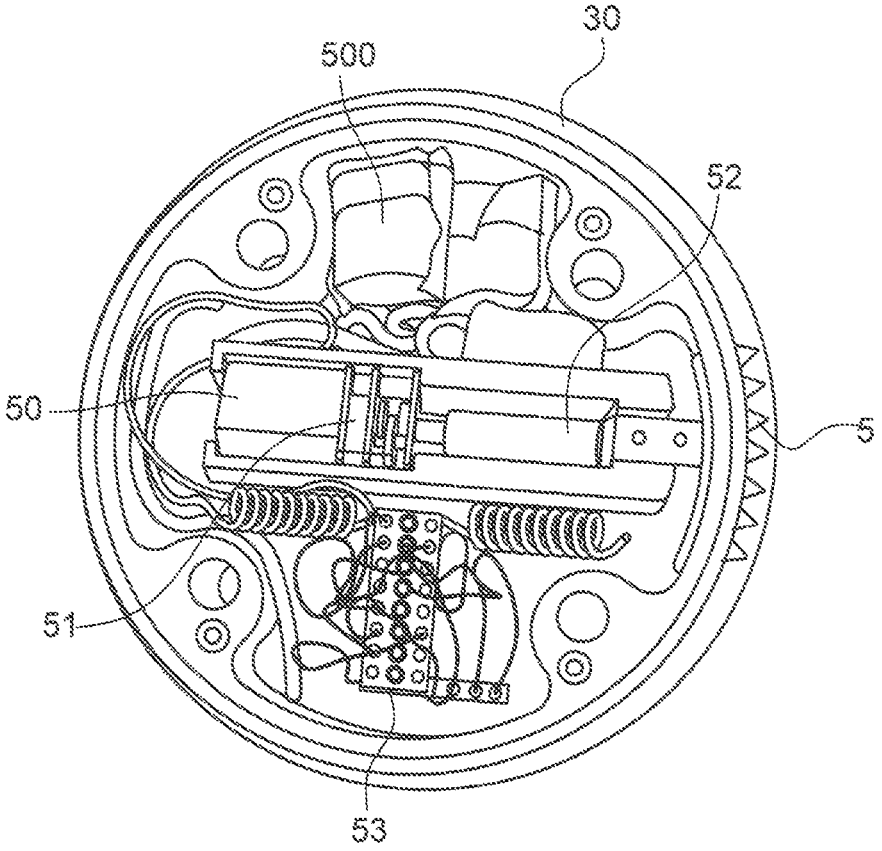
FIG. 6 shows the locking member mounted in a disk and various components of its actuation mechanism, the locking member in FIG. 6 is in the locked position.
Figure 7:
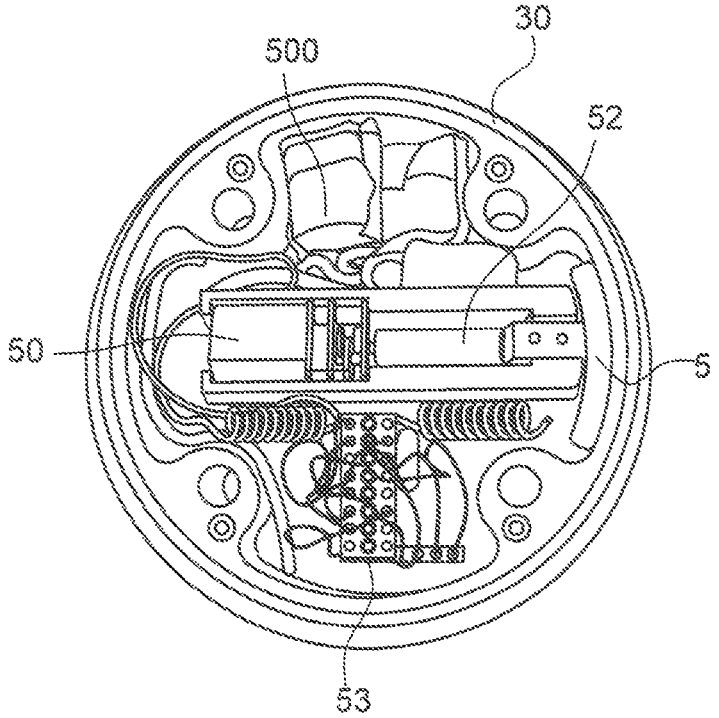
FIG. 7 shows the locking member in the unlocked position.
Figure 8:
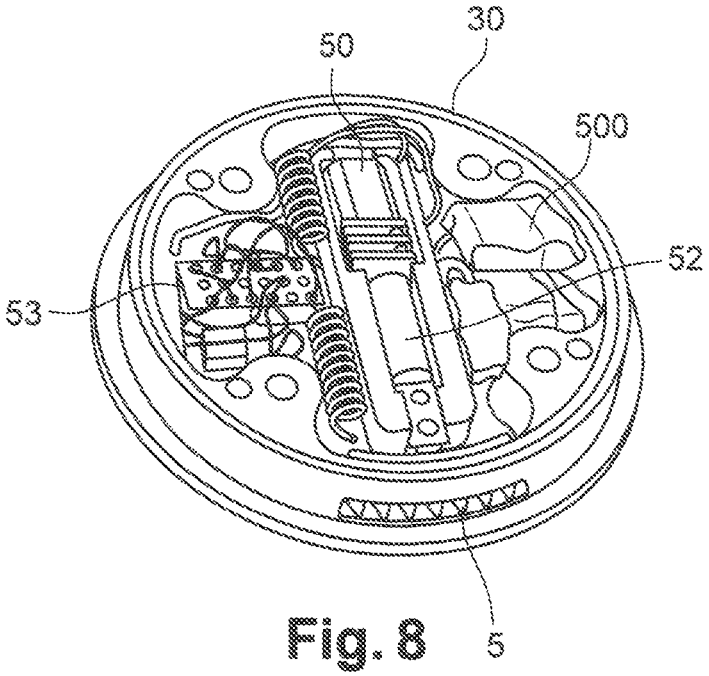
FIG. 8 shows the locking member in the unlocked position.

To block the rotation of the ring 40 relative to the disk 30, at least one locking member is provided. In FIGS. 6 to 8, this locking member is in the form of retractable teeth 5 installed in the disk 30. These teeth 5 are movable between a locked position 15 where they project radially outwards from of the disk 30 (FIG. 6), and an unlocked position where they retract towards the interior of said disk 30 (FIGS. 7 and 8). In FIGS. 6 to 8, a single set of teeth 5 is illustrated. However, it is possible to envisage several sets of teeth 5 (for example two or more), arranged anywhere on the axis of symmetry of the disk 30.

In the locked position, these teeth 5 engage with the internal teeth 410 of the ring 40 so that said ring 40 is immobilized in relation to the disk 30. As a result, the binding 21 is immobilized in relation to the board 1.

In the unlocked position, the teeth 5 and 410 are disengaged so that the ring 40 can rotate freely around the axis of rotation X-X. As a result, the binding 21 can be adjusted angularly in relation to the board 1.

The movement of teeth 5 between the locked position and the unlocked position is ensured by an actuator which can be controlled remotely. This actuator is integrated in the assembly E, and more particularly in the disk 30, so that it can be actuated even when the boot C is retained in the binding 21. This actuator comprises an electric motor 50 powered by one or several batteries 500 or rechargeable batteries (for example via a USB cable). The motor 50 rotates, via a reduction device 51, a screw. A nut 52, integral with the teeth 5, is engaged with this screw 51 so that a rotation in one direction or the other of said screw 51 causes a shift towards the front (i.e., towards the locked position) or towards the back (i.e., towards the unlocked position) of said nut 52 and therefore of said teeth 5.

In the alternative embodiment of FIGS. 11 to 14, two sets of teeth 5 are arranged symmetrically with respect to the axis of symmetry of the disk 30. These teeth 5 are engaged with a cam 510 mounted movable in rotation on an axis 5100. The electric motor 50 ensures the rotation of the cam 510 about the axis 5100. The teeth 5 are in direct contact with the profile of the cam 510, said profile is configured so that the rotation of said cam 510 causes said teeth 5 to shift from the unlocked position (FIGS. 11 and 12) to the locked position (FIGS. 13 and 14). The teeth's 5 return from the locked position to the unlocked position is ensured by one or more return springs 511 engaged with each of said teeth 5. In the unlocked position, the teeth 5 project radially outside a surface 300 of the disk 30 (FIG. 12), and in the unlocked position they retract inside said surface 300 (FIG. 14). A combination of seals 512 seal the disk 30 and the electrical and electronic elements inserted therein.

Compared to the embodiment of FIGS. 2 and 6 to 8, this alternative embodiment makes it possible to use only one motor 50 to move a pair of 30 teeth 5. There is thus a gain in space in the disk 30, which allows the use of a more powerful battery 500, giving more autonomy to the device. In addition, it is now the cam 510 (and no longer the axis of the motor 50) which collects the radial forces induced by the teeth 5 when they are engaged with the internal teeth 410 of the ring 40 so that a torque (for example exerted by the user's foot) is generated around the axis of rotation X-X of the binding 21.

Whatever the embodiment, the actuator, and more particularly the motor 50, is controlled in response to the reception of a command signal sent from a transmitter. This command signal is received by a receiver 53 installed in the disk 30, said receiver 53 is part of the electronics adapted to control the rotation of the motor 50 in one direction or the other. According to the command signal received by the receiver 53, the motor 50 is thus actuated to move the teeth 5 towards the locked position or towards the unlocked position.

In FIG. 2, the transmitter is in the form of a remote control 6 integrated in a bracelet adapted to be worn by the snowboarder. To simplify the design, this remote control 6 transmits radio frequency or Bluetooth signals and includes a button 61 for the emission of a teeth locking signal 5 and another button 62 for the emission of an unlocking signal 20 of said teeth 5. According to an alternative embodiment, provisions can be made for the transmitter to be integrated into a smartphone and for the signals to be transmitted by Bluetooth or by radio frequencies. Whatever solution is chosen for the transmitter, it is obvious that the receiver 53 is adapted to the format of the control signals transmitted.

The mounting of the adjustment device is as follows: the user has his board 1, his binding 21, and the assembly E formed by the disk 30 and the ring 40 separately. The user positions the binding 21 on the base 10 and adjusts the angular adjustment of said binding 21. Once the orientation angle "a" has been adjusted, the user positions the assembly E in the arrangement 2111 produced in the baseplate 211 of the binding 21 so that the external teeth 400 of the ring 40 come into contact with the teeth 2110 of said arrangement. The user then fixes the bindings 21 by securing the disk 30 on the base 10. There is therefore a setting device which is fixed to the board 1 by a system of extreme simplicity.

The user can adjust the orientation of his binding 21 even when his boot C is retained therein. To do this, the user activates the transmitter 6 to generate a command signal making it possible to pass the teeth 5 from the locked position to the unlocked position and release the rotation of the ring 40. By rotating his foot, the user can then modify the angular position of the ring 40 and of the binding 21. Once the angular position has been chosen, the user activates the transmitter 6 to generate a second command signal making it possible to pass the teeth 5 from the unlocked position to the locked position and block the rotation of the ring 40. It is therefore a very rapid setting device and very simple to use. The electronics integrated in the disk 30 can also include a timer adjusted to automatically return the teeth 5 from the unlocked position to the locked position, at the end of a determined time, which avoids having to transmit the second command signal.

In FIG. 9, only the front binding 21 is equipped with the setting device. The rear binding 22 is itself provided with a conventional angle setting device, for example of the type described in patent documents FR2876041 (Rossignol) or US 2011/0254239 (Jung) mentioned above. However, this rear binding 22 can also be equipped with a setting device according to the invention. In this FIG. 9, the bindings 21, 22 are oriented for the practice of snowboarding, when the user descends a slope.

Figure 10:
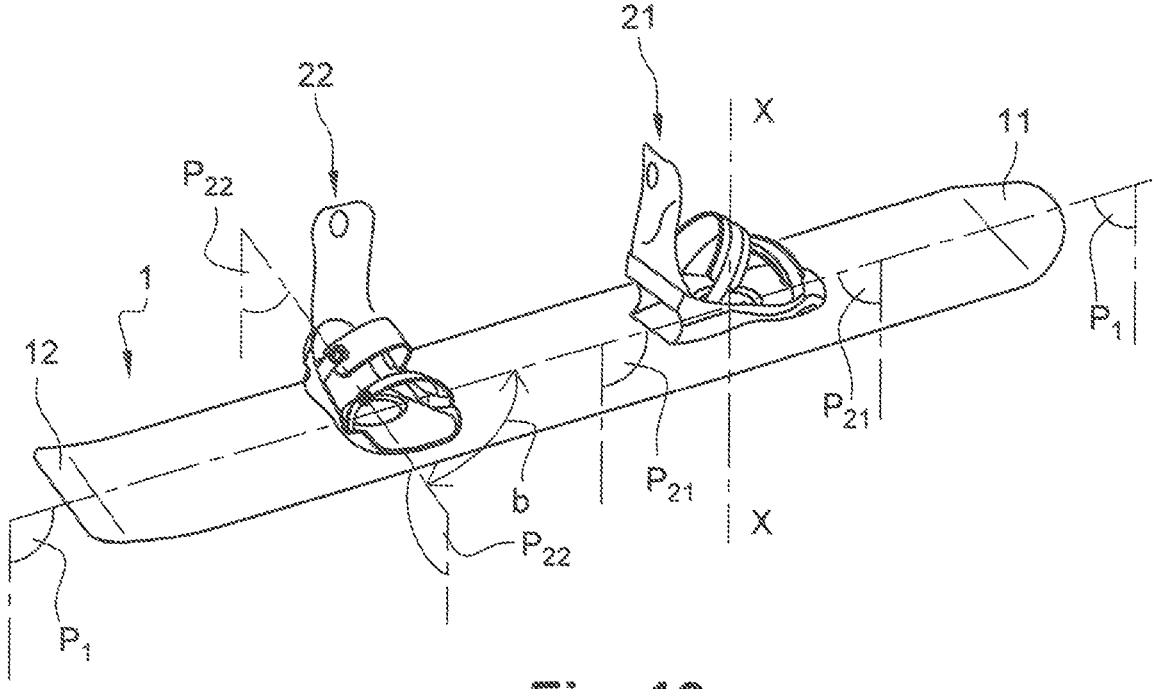
FIG. 10 shows the board of FIG. 9 where the front attachment is in a second angled position, corresponding to when the user uses a ski lift.

In FIG. 10, the user has used the adjustment device to adjust the orientation angle "a" of his front binding 21, so that the vertical plane of symmetry P21 of said binding coincides with the vertical plane of general symmetry P1 of the board 1. By taking off his rear foot, the user finds himself with the front foot in the axis of the board 1. The user can then take a drag lift (surface ski lift) and climb with the hips facing the slope. In the case of a chairlift (aerial ski lift), the user can also sit properly in the seat, his board 1 facing the slope and his front foot in the axis of his board 1. The user is therefore in a very comfortable position when using any ski lift.

The arrangement of the various elements and/or methods and/or steps of the invention, in the embodiments described above, should not be understood as requiring such an arrangement in all implementations. The technical characteristics described only in relation to one embodiment can be used in other embodiments. In any event, it will be understood that various modifications can be made to these elements and/or methods and/or stages, without deviating from the spirit and scope of the invention. In particular:

- The locking member 5 is not necessarily in the form of teeth, but may be in the form of one or more indexing fingers adapted to be inserted in a slot of complementary shape arranged on the inner side of the ring 40.
- The ring 40 is not necessarily attached but can be directly integrated into the binding 21. It can in particular be shaped at the level of the arrangement 2111 produced in the base plate 211 of the binding 21, and for example obtained during the molding of said plate 211.
- The actuator can be in the form of an electric actuator or a rack-and-pinion engaged with the locking member 5.

The invention claimed is:

1. A device for setting an orientation of a binding of a boot on a snowboard, comprising:

- a disk configured to be fixed to the snowboard, the binding being mounted movable in rotation relative to said disk, around a vertical axis of rotation;
- a ring is mounted movable in rotation in relation to the disk around the vertical axis of rotation;
- at least one locking element mounted adjustably between:
  - a locked position where the binding is immobilized in relation to the disk, and
  - an unlocked position where the rotation of the binding around the vertical axis of rotation for an angular adjustment of said binding in relation to the board is allowed; and
- a shift of the locking element between the locked position and the unlocked position is ensured by an actuator,
- wherein the actuator is remotely controllable, the locking element and the actuator are installed in the disk so that said actuator can be actuated when the boot is retained in the binding, and said locking element is movable by said actuator when the boot is retained in said binding, and the locking element is in the form of retractable teeth installed in the disk and which, in the locked position, cooperate with complementary teeth arranged on the ring.

2. The setting device according to claim 1, wherein the ring is engaged with the binding so that the rotation of said binding causes said ring to rotate, in the locked position, the locking element immobilizes the ring in relation to the disk, and in the unlocked position, the locking element allows the rotation of the ring around the axis of rotation and an angular adjustment of the binding in relation to the snowboard.

3. The setting device according to claim 2, wherein the actuator is controlled in response to reception of a command signal sent from a transmitter.

4. The setting device according to claim 3, wherein the transmitter is a remote control integrated in a bracelet adapted to be worn by a user.

5. The setting device according to claim 3, wherein the transmitter is integrated in a smartphone.

6. The setting device according to claim 1, wherein the actuator is controlled in response to reception of a command signal sent from a transmitter.

7. The setting device according to claim 6, wherein the transmitter is a remote control integrated in a bracelet adapted to be worn by a user.

8. The setting device according to claim 6, wherein the transmitter is integrated in a smartphone.

9. The setting device according to claim 8, wherein the command signal transmitted by the transmitter is a radio frequency signal.

10. The setting device according to claim 8, wherein the command signal transmitted by the transmitter is a Bluetooth signal.

11. The setting device according to claim 6, wherein the command signal transmitted by the transmitter is a radio frequency signal.

12. The setting device according to claim 6, wherein the command signal transmitted by the transmitter is a Bluetooth signal.

13. A snowboard comprising a pair of boot bindings, a front binding set up at a front of the snowboard and a rear binding set up at a rear of said snowboard, wherein the front binding and/or the rear binding is equipped with the setting device in accordance with claim 1.

14. The snowboard according to claim 13, wherein an orientation angle of the front binding is adjustable so that a vertical plane of symmetry of said front binding coincides with a general vertical plane of symmetry of said snowboard.

* * * * *